US006405654B1

(12) United States Patent
Smith

(10) Patent No.: US 6,405,654 B1
(45) Date of Patent: Jun. 18, 2002

(54) MUZZLE-LOADER PROJECTILE WITH A PLASTIC INSERT

(76) Inventor: Tim T. Smith, 1949 Canterbury Sq., Anniston, AL (US) 36207

( * ) Notice: Subject to any disclaimer, the term of this patent is extended or adjusted under 35 U.S.C. 154(b) by 0 days.

(21) Appl. No.: 09/778,647

(22) Filed: Feb. 8, 2001

(51) Int. Cl.[7] ..... F42B 12/34
(52) U.S. Cl. ..... 102/517; 102/501; 102/510
(58) Field of Search ..... 102/501, 507–511, 102/514–517, 529, 524–527

(56) References Cited

U.S. PATENT DOCUMENTS

| | | | | |
|---|---|---|---|---|
| 4,108,074 A | * | 8/1978 | Billing, Jr. et al. | 102/529 |
| 4,353,282 A | * | 10/1982 | Holt | 102/511 |
| 4,417,521 A | * | 11/1983 | Dahlitz | 102/511 |
| 4,610,205 A | * | 9/1986 | Bentley | 102/524 |
| 5,435,089 A | | 7/1995 | Rodney, Jr. | |
| 5,811,723 A | | 9/1998 | Stone | |
| 6,070,532 A | | 6/2000 | Halverson | |

FOREIGN PATENT DOCUMENTS

| | | | | |
|---|---|---|---|---|
| EP | 578981 | * | 1/1994 | 102/529 |

OTHER PUBLICATIONS

T/C Maxi—Ball, Thompson/Center Arms, Dec. 22, 2000.*
T/C Maxi—Hunter, Thompson/Center Arm, Dec. 22, 2000.*
40 QT Spitzer Polymer Tip, Precision Rifle Home Page, Jan. 2, 2001.*

* cited by examiner

*Primary Examiner*—Harold J. Tudor
(74) *Attorney, Agent, or Firm*—F. Rhett Brockington

(57) ABSTRACT

The invention is an improved ammunition for use in muzzle-loader guns, where the invention is a muzzle-loader projectile that is substantially conventional in overall appearance to prior art, black powder projectiles, but differs significantly in that it has a plastic center that extends to the tip of the projectile, therein producing a lighter, streamlined projectile that has a higher muzzle velocity, and a truer, flatter trajectory than conventional solid lead projectiles; and, where said invention, on impact, mushrooms extensively, efficiently transferring all of its kinetic energy to the target.

7 Claims, 4 Drawing Sheets

MUZZLE-LOADER PROJECTILE WITH A PLASTIC INSERT

The invention relates to ammunition for muzzle-loader guns, and more particularly to muzzle-loader ammunition having a higher velocity, flatter trajectory, and higher kinetic energy.

BACKGROUND OF THE INVENTION

Recognizing the central role that hunting played in the historical development of the United States, sporting enthusiasts and the regulating bodies governing the sport, have overseen a huge interest in hunting using black powder, muzzle-loader guns. In many states, special hunting seasons have been created for the exclusive use of muzzle-loader rifles. The ammunition used in muzzle loaded rifles has evolved from a projectile that is a round ball, to projectiles that have incorporated features of modern bullets. Within the latter category, bullet shaped projectiles can be further subdivided into those that are fired with a sabot, and projectiles that are lubricated slugs. A sabot is an encasing plastic cup that falls away from the projectile after it exits the gun. The sabot eliminates the need for a lubricating means and assures that there is a good seal between the projectile and the bore of the muzzle. Sabots, while generally creating much higher muzzle velocities, can negatively influence the trajectory of the projectile if the sabot does not break away cleanly, and can obstruct the barrel especially, in cases where the rifling ratio is lower than 1:48. A larger caliber gun is required to fire a sabotted bullet. For instance to fire a 50 caliber projectile with a sabot, a hunter needs a 54 caliber gun. Additionally, when using sabotted ammunition, the hunter has to deal with safety issues arising as a consequence of the plastic sabot. If the bullet and sabot are not compatible or properly fitted by size, a sabotted bullet can produce barrel obstruction.

Most states regulate the size of a muzzle-loader projectile to a maximum height of twice the diameter. This regulation has an amplified effect on sabotted bullets, in that compensating length cannot be added to overcome the effect of using a smaller caliber bullet. Another consideration is the growing consensus among muzzle-loader enthusiast and regulators that sabots, which were originally developed for launching large artillery, do not reflect the sporting nature of using a muzzle-loader rifle, and some states are considering banning sabotted bullets. Lubricated slugs are much closer in concept to the original muzzle-loader ammunition. Typically, the lubricated slug is a longitudinally symmetrical solid that is substantially a banded cylinder capped with a conical head. The lubrication is retained by the circular bands, hereinafter referred to as bearing bands, and the lubrication is usually either a natural product such as one of the vegetable or animal fatty oils, or a petroleum based oil. The lubricated slug is usually homogeneously comprised of a metal that is predominately lead. Lead is preferred because it is soft enough that the rifling graves it easily, and because lead represents a good balance of properties between weight and resistance to deformation. Ideally, the muzzle-loader projectile should distort very little until it impacts the target. It is know in the art that the shape of the head of the projectile can effect how much expansion occurs on impact. Jeffrey W. Stone of Remington® Arms Company describes in U.S. Pat. No. 5,811,723 a bullet having superior expansion. The tip of the bullet has a hollow point. In a related patent, Halverson of Olin®, U.S. Pat. No. 6,070,532 addresses the issue of aerodynamics of hollow point bullets, in that their performance is inferior to a solid conical bullet.

He discloses methods that result in improved properties, by increasing the aspect ratio (length to diameter) and increasing the curvature of the nose of the bullet. This modification to Stone's invention, in effect trades off reduced expansion, which is reflected in lowered killing efficiency, for greater accuracy. What is desired is a projectile having the performance of a full hollow point without the accompanying reduction of accuracy. Furthermore, if the degree of hollowing can be increased over Stone's invention, without loss of aerodynamic properties, the resulting projectile would have even greater expansion, and would be an improved muzzle-loader projectile. Greater expansion or mushrooming would result in a projectile having improved transference of the kinetic energy into the target. Precision Rifle advertises on their web site that filling the hole of a sabotted hollow point bullet with plastic causes the bullet to have greater expansion. The issue is somewhat clouded by the fact that sabotted bullets have a high velocity, and expansion is not generally considered a problem.

A recognized favorite ammunition of muzzleloaders hunters are the Maxi-Ball® and the Maxi-Hunter® of Thompson Center Arms®. The Maxi-Ball has a blunt tip and three bearing bands. The diameter of the two posterior bearing bands is slightly less that the top bearing band, where the top bearing band is substantially equal to the diameter of the inner bore of the corresponding rifle. F. Rodney's U.S. Pat. No. 5,435,089 reads on typical dimensions of the gun with rifling. Often, the inner bore, which is the diameter of the rifling, is approximately 20 mils narrower than the outer bore. The configuration of the bearing bands described for the Max-Ball enables this muzzle-loader projectile to be aligned properly when loaded into the gun. The top bearing band actually graves during loading, assuring a very good seal. The Maxi-Hunter, which is a heavier projectile, has a fourth bearing band that acts primarily as an additional seal. The additional bearing band suggest that heavier projectiles need another seal, because the chamber pressure builds so high as to allow some of the explosive gases to seep past the first two bands. The implication of the additional bearing band is that within the constraints of hunting rules using muzzle-loader rifles and ammunition, heavier projectiles are not necessarily efficiently imparted with higher kinetic energy, because of the design restraints placed on the sport. In fact, a projectile propelled by black powder, that is lighter than a similar dimensioned heavier projectile, is known to have a significantly higher muzzle velocity. Energy, and specifically kinetic energy, are a function of one half times the mass times the velocity squared ($KE=(\frac{1}{2})\cdot m\cdot v^2$). A 10% increase in mass results in a 10% increase in kinetic energy, while a similar 10% increase in muzzle velocity results in a 100% increase in kinetic energy. Additionally, a projectile having a higher muzzle velocity will have a flatter trajectory. By way of illustration, a projectile weighing 23% lighter than another, will, theoretically, have a trajectory fall that is 21% less, assuming that both projectiles have the same kinetic energy. A desired second improvement is a muzzle-loader projectile having a lower weight with substantially the same overall dimensions.

SUMMARY OF THE INVENTION

The invention is a muzzle-loader projectile that is a very high impact bullet, having a flattened trajectory. The invention, while having significant performance improvements, is designed to remain within the scope of the technology employed in the sport of muzzle-loader hunting, and this is a central theme to the invention. It is anticipated that the invention will result in quicker knock-downs, and fewer wounded animals due to higher kinetic energy and increased hunter accuracy. The muzzle-loader projectile can be appropriately sized to fit all muzzle-loader firearms, including pistols and shot guns, but most especially rifles. The invention includes all caliber ammunition (i.e. 22, 32, 44, 45, 50, 54, 58; shot gun sizes 10, 12, 16, 20, 28, .410 and metric sizes, i.e. 6, 9 mm). Muzzle-loaders are typically sized in the 32 to 58 caliber ammunition size range.

It is a first object of the invention is that the muzzleloader projectile can be made up to 60% lighter than conventional muzzle-loader projectiles of the same caliber, and still have substantially similar overall dimensions of length to diameter.

A second object of the invention is that muzzleloader projectile performs like a HP bullet having a very deep and wide hollow point head, yet retains the aerodynamic properties of a conical head. A corollary to the second object is that the desired mushrooming effect of hollow point bullets will occur, even at extended distances and at velocities below 900 fps.

A third object is that the invention will have performance enhancing higher muzzle velocities, and will have a flatter trajectory.

The typical dimensional design constraints on muzzle-loader projectiles limit the length to diameter ratio to 2:1. For a 50 caliber bullet this is 1.0 inches long and 0.5 inches in diameter. A solid slug of pure lead, having a blunted conical head with a short ogive weighs approximately 400 grains. After performance features are added, such as lubrication grooves and bearing bands the weight drops to around 390 grains. Add a hollow point and the weight will drop another 50 to 70 grains, depending on the depth of the hollow. Accuracy at 100 yards is good. However, beyond that distance, theoretical calculations predict that there will about a 3 inch drop for every 10 yards up to 200 yards. The present invention extends the effective range, and cuts that rate of fall to half or lesser, having a much flatter trajectory allowing for more accurate shot placement and less guessing for hold over by the shooter at greater distances. Fewer wounded animals could be expected.

The invention is a muzzle-loader projectile with a conical head, where said projectile is a unified assembly of a socket and a plastic insert, where said socket is a banded cylinder having a base and a capping frustoconical head, wherein through the head and at least halfway down the cylinder there is a longitudinal, symmetrical, open ended coaxial cavity, where said plastic insert is a solid cylinder having a conoid, wherein the plastic insert substantially fills the cavity and projects outward forming at least a major portion of the conical head. The plastic insert is comprised of a lower weight density material, relative to lead. Preferably, the material is an engineering plastic like certain polyesters, polyamides, polycarbonates, acrylics and methacrylics, urethanes, harder polyolefins and vinyls, polyimides, epoxies, styrenics, acetals, ketals, and other relatively hard plastics. The plastic can be colored, filled with reinforcing fillers such as fiberglass, and the plastic can contain weight reducing composites like glass beads. The plastic insert is tightly fastened to the cavity of the socket, where the cavity has an interior contour that closely matches an exterior contour on the plastic insert that is largely encased by the cavity. An exterior portion of the plastic insert, namely the conoid, protrudes beyond the narrowed portion of the frustoconical head of the socket. The two conicals match, and extend the length of the projectile as a smooth unified assembly, the assembly terminating in an apex.

The inclusion of the plastic insert results in an overall reduction in weight of 10% to 60% of a solid, all lead muzzle-loader projectile. With the same charge of powder an increased muzzle velocity is calculated using conventional ballistic calculations. Table 1 shows the predicted results for a 50 caliber bullet. Calculations are based on a projectile having the following overall dimensions. The diameter is 0.5 inches and the height is 0.975 inches. The banded cylinder has three bearing bands that circumscribe the projectile. A gap between two bearing bands serves as a lubrication reservoir. The bearing bands do not significantly effect the weight calculations, but were included as described in the Detailed Description Of The Invention which follows below. The dimensions for the plastic insert are given Table 1. The radius of the conoid and the radius of the solid cylinder are equal. By necessity the volume of the socket is reduced as the volume of the plastic insert is increased, therein keeping the overall dimensions constant. Item 1 is an exception as there is no plastic insert, however, again the overall dimensions are constant. The relative percentage of the projectile that is plastic increases as the item number increases. Examining the table, it become apparent that most significantly, a projectile having the same overall dimensions, but weighing less, has a lot higher muzzle velocity. The higher muzzle velocity translates into greater mushrooming of the head and transference of kinetic energy at the point of impact, even 100 to 200 yards away.

TABLE 1

| Item No. | Plastic Insert (inches) R, H (cyl), H (con) | Projectile wt.(grains) | % of all lead Projectile | Kinetic Energy (ft*lbs) | Muzzle Velocity (fps) |
|---|---|---|---|---|---|
| 1 | 0, 0, 0 | 386 | 100 | 1448 | 1300 |
| 2 | 0.125, 0.725, 0.125 | 288 | 74.5 | 1452 | 1507 |
| 3 | 0.175, 0.663, 0.188 | 204 | 52.8 | 1449 | 1789 |
| 4 | 0.175, 0.725, 0.188 | 188 | 48.7 | 1445 | 1861 |

The ballistic trajectory calculations for the four items are shown in Table 2. As noted earlier the velocity of the three examples with a plastic insert, numbered 2–4, retain a velocity of over 1100 fps, even at 200 yards. Note also, that the trajectory at 200 yards, is much flatter for projectiles that have an approximate 50% weight reduction. Below 200 yards, Table 2 shows no difference, however once you start adding in the effect of wind, the higher velocities result in shortened times to reach the target, less wind effect, and higher accuracy.

TABLE 2

| Item No. | Velocity at 100 yds. (fps) | Velocity at 200 yds. (fps) | Inches fall at 100 yds. | Inches fall at 200 yds. | Inches fall at 300 yds. |
|---|---|---|---|---|---|
| 1 | 1151 | 1047 | 0 | 24 | 81 |
| 2 | 1315 | 1163 | 0 | 18.7 | 63 |
| 3 | 1559 | 1359 | 0 | 12.9 | 45 |
| 4 | 1624 | 1415 | 0 | 11.8 | 41 |

The invention, from the hunter's perspective, is about an incremental improvement to his equipment. The improvements do not result in major changes in the sport, but do give the hunter an opportunity to make a more accurate shot. Furthermore, the addition of the plastic insert creates a projectile that will mushroom out much more than existing muzzleloader ammunition, because the effective depth of the hollow has been extended from a point confined to the head, to very nearly 90% of the entire bullet.

DETAILED DESCRIPTION OF THE INVENTION

Figure 1:
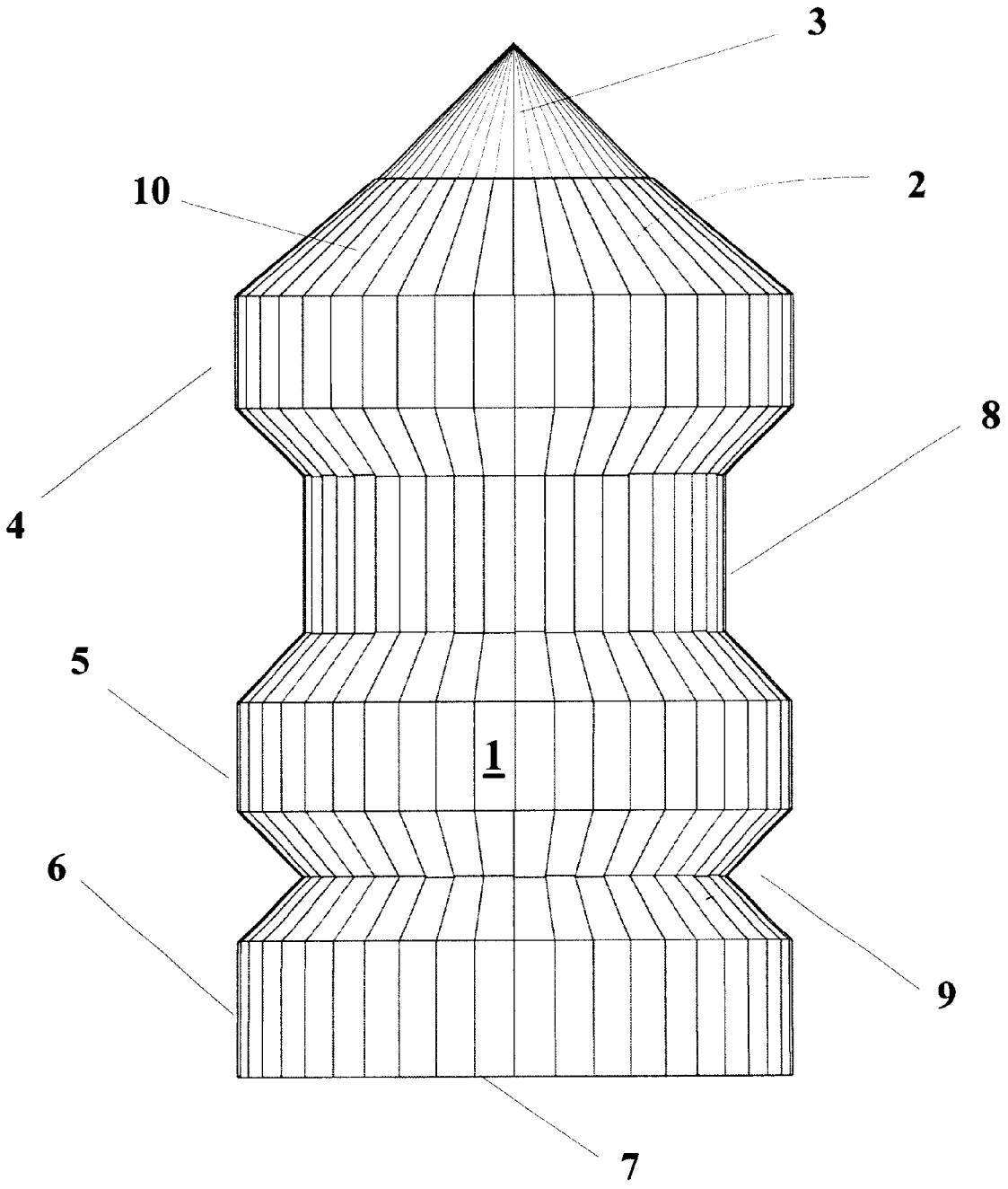
FIG. 1 is a perspective view of the invention.
Figure 2:
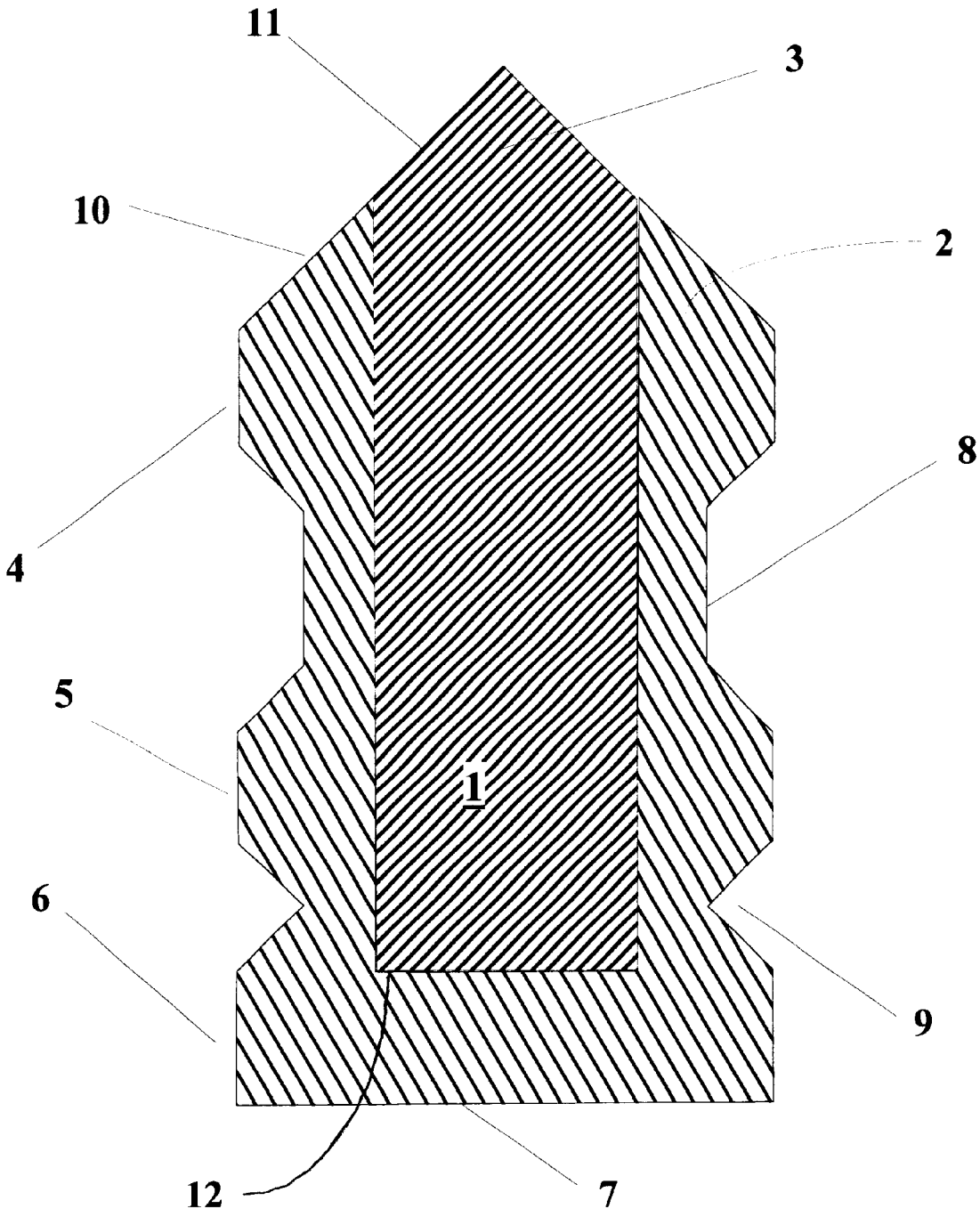
FIG. 2 is a longitudinal cross-sectional view of a preferred embodiment of the muzzle-loader projectile, in a plane taken along sectional line 2—2.
Figure 4:
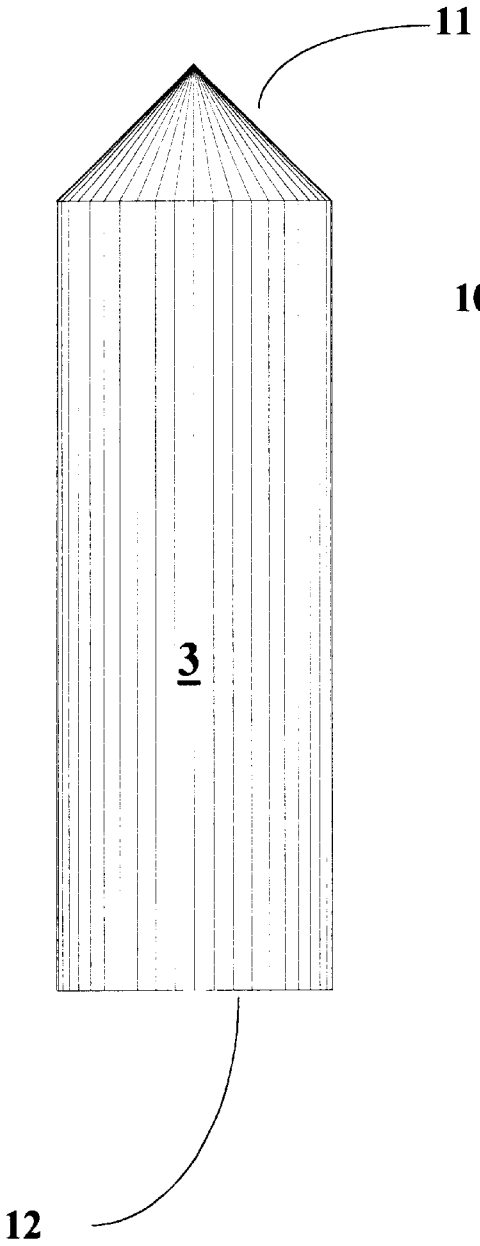
FIG. 4 is an isotropic, schematic view of the plastic insert.
Figure 3:
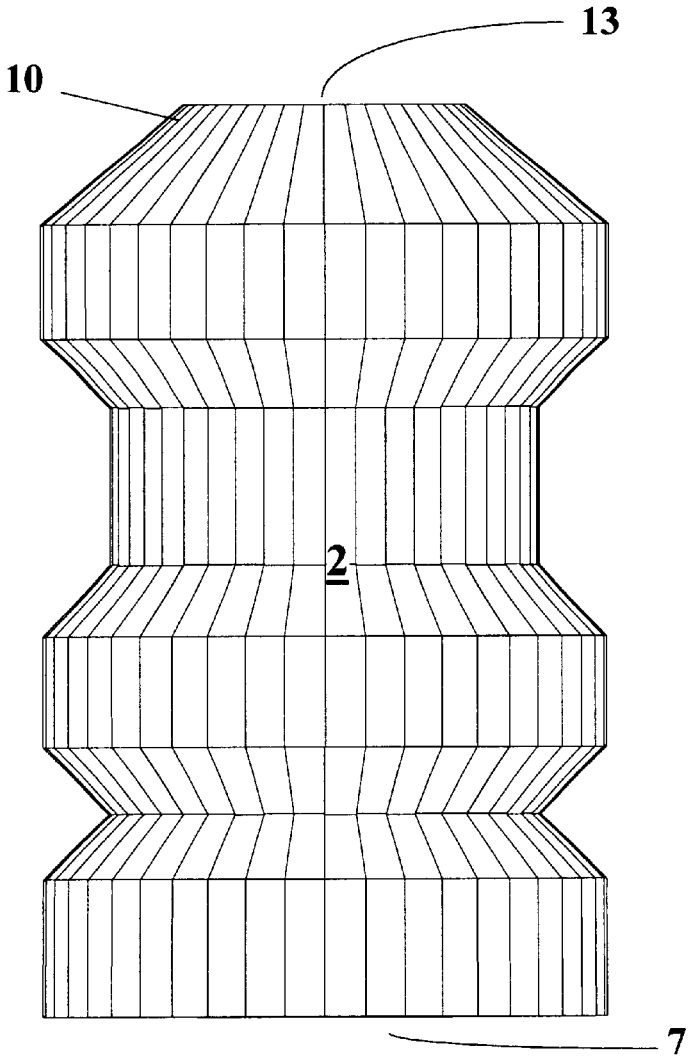
FIG. 3 is an isotropic, schematic view of the invention with the plastic insert removed.
Figure 5:
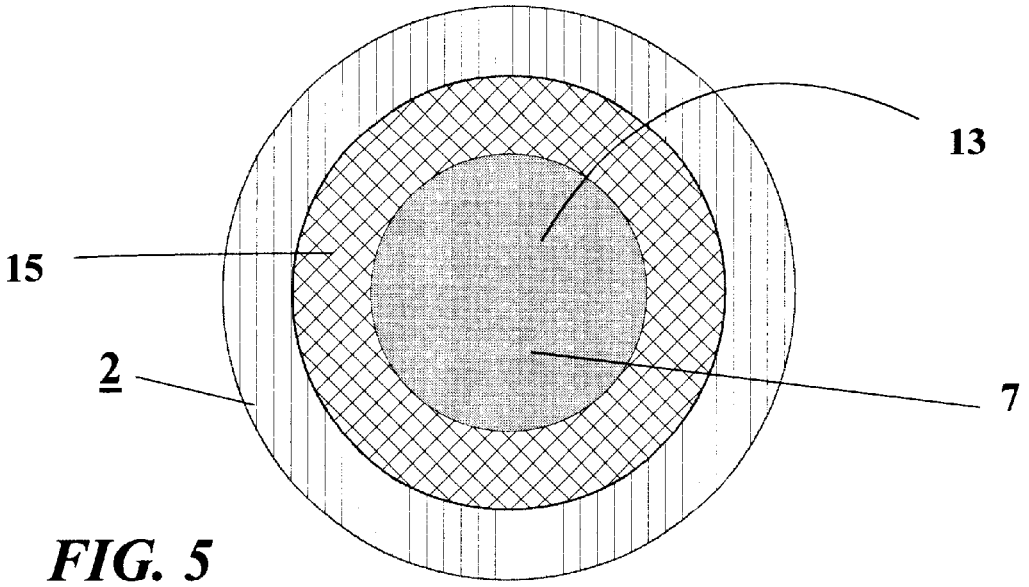
FIG. 5 is an overhead, planar view of the socket.
Figure 6:
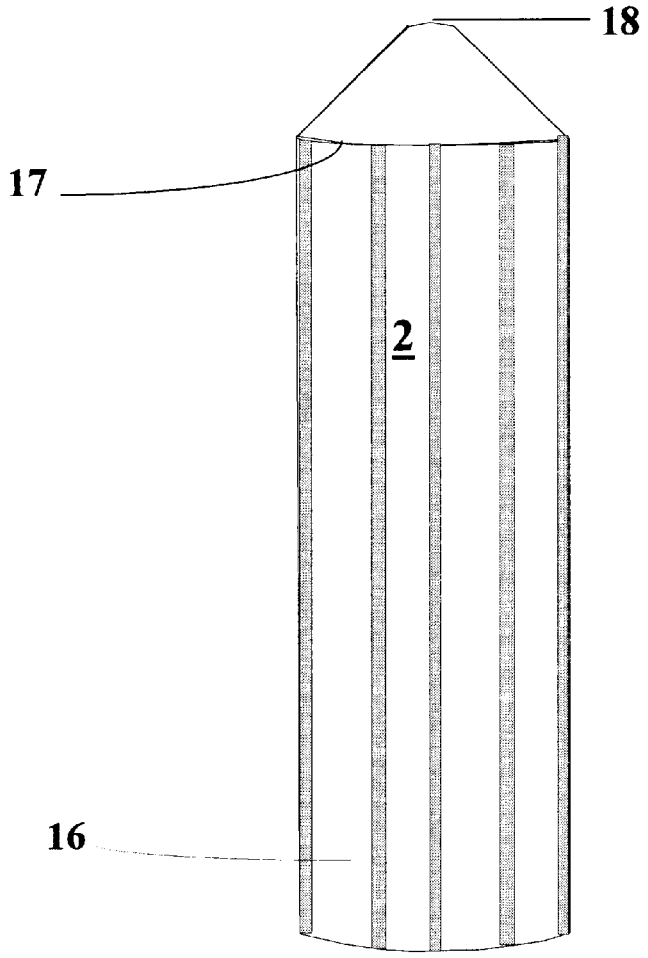
FIG. 6 is an isotropic view of a plastic insert having longitudinal splines.

For purposes of illustration only, the invention shown in the figures is sized for a 50 caliber rifle. The size of the projectile would be appropriately adjusted in dimensions for a different caliber. A height to diameter ratio has been chosen which reflects the current accepted constraints of the sport, however it is realized that the proportions could be adjusted to either a higher or lower aspect ratio. In FIG. 1 the invention 1, has a base 7 diameter that is 0.500 inches across. The overall height of the invention 1 is 0.975 inches. There are three bearing bands, 4, 5, and 6. The diameters of 5 and 6 are both 0.500 inches, while band 4 is 0.504 inches. The width of bands of 4 and 5 is 0.100 inches, and the width of band 6 is 0.125 inches. The two lower bands are slightly smaller in diameter such that during loading, the base of the projectile will enter the muzzle without being graved by the rifling. The top bearing band is sized such that it will contact the rifling, and be slightly graved when pushed down the barrel. The recesses, 8 and 9, between the bearing bands are reservoirs for a lubricant. The lubricant oils the bearing bands before loading, during loading and after firing. The lubricant is designed to cut down on friction and lead filings formation. As viewed in FIG. 1, the projectile conical head is a metalloid composite of a frustoconical head portion 10 of the socket 2 and a conoid extension portion of the plastic insert 3. FIG. 2 is a longitudinal cross sectional view of the invention 1, taken down a center-line, defined by the plane of sectional line 2—2. Note the side to side symmetry of the socket 2 and the plastic insert 3, and that the interior wall 15 (see FIG. 5) of the cavity 13 is substantially flush with the exterior wall of the plastic insert, as shown at the interface 12. The base 7 is solid metal, lead. The plastic insert 3 is comprised of a polyamide, Nylon®, which is colored red to reflect the style and caliber. FIGS. 3 and 4 are schematic isotropic views of the two sub-assemblies, 2 and 3. The views are self-explanatory. The plastic insert has an overall height of 0.850 inches. The height of the conoid is 0.125 inches and the cylinder is 0.725 inches. The diameter of 3 is 0.250 inches. The overall height of the socket is 0.850. The height of the frustoconical head is 0.125, and the cylindrical height is 0.725 inches. FIG. 5 is a overhead planar view of the socket 2. The entrance to the cavity 13 is shown in this view. One can look all the way to the bottom of the cavity 13 and see the base 7. FIG. 6 is a view of the plastic insert 3 having pronounced splines 16. In this embodiment splines 16 are clearly shown. The splines 16 perform two functions. They act as a channel to allow air or adhesive to be expressed during assembly, and they slightly increase the diameter, such that when the plastic insert 3 is pressed into the cavity 13, there is sufficient resistance to hold the two sections together. The splines 16 are sufficiently narrow such that there is no distortion of the overall outside dimensions of the invention 1. The apex 18 of the conoid is slightly rounded, and there is a ridge 17 that extends to cover the splines 16.

I claim:

1. A high velocity muzzle-loader projectile having a conical head, where said projectile, having a length that is not greater than twice its diameter, is a unified assembly comprising:

a metal socket where said socket is substantially a banded cylinder, having an open-ended coaxial cavity, extending at least halfway down said socket and a solid base, wherein, circumscribing said cylinder, there are bearing bands and at least one intervening channel for storing and metering a lubricant, where the bearing band nearest the conical head is a rifling band which is sufficient in diameter that it is graved upon loading, and bearing bands below the rifling band having diameters which are less than the diameter of the rifling band so that the projectile can be easily aligned and loaded in a barrel of a muzzle-loader; and a plastic insert, which is substantially a solid cylinder having a conoid;

where said plastic insert substantially fills the coaxial cavity, and wherein said conoid is coextensive and projecting beyond the socket forming at least a major portion of the conical head.

2. A muzzle-loader projectile as claimed in claim 1 where the metal socket is substantially comprised of lead.

3. A muzzle-loader projectile as claimed in claim 1 where the plastic insert is comprised of an engineering plastic selected from the group consisting of polyesters, polyamides, polycarbonates, acrylics and methacrylics, urethanes, harder polyolefins and vinyls, polyimides, epoxies, styrenics, acetals, and ketals.

4. A muzzle-loader projectile as claimed in claim 1, wherein said plastic insert is of sufficient size and density as to effect an overall reduction of weight of at least 10%, as compared to a solid lead projectile of similar overall dimensions.

5. A muzzle-loader projectile as claimed in claim 1, wherein the conoid of the plastic insert terminates in a pointed tip, and therein has significantly less aerodynamic drag than a conventional hollow point bullet of similar overall dimensions and therein, on impact, mushrooms more than the conventional hollow point bullet.

6. A muzzle-loader projectile as claimed in claim 1, wherein the projectile is lighter, and with a similar charge of black powder attains a weight proportional higher muzzle velocity than a solid lead projectile of similar overall dimensions.

7. A muzzle-loader projectile as claimed in claim 5, and where the projectile is lighter than an all lead bullet, wherein said projectile has a flat trajectory and mushrooms more than the conventional hollow point bullet.

* * * * *